United States Patent [19]

Yoo

[11] 4,448,585

[45] May 15, 1984

[54] PROCESS FOR FORMING STABLE COAL-OIL MIXTURES

[75] Inventor: Jin S. Yoo, Flossmoor, Ill.

[73] Assignee: Atlantic Richfield Company, Philadelphia, Pa.

[21] Appl. No.: 334,691

[22] Filed: Dec. 28, 1981

[51] Int. Cl.[3] ..... C10L 1/32; C10L 9/02

[52] U.S. Cl. ..... 44/51; 44/1 SR

[58] Field of Search ..... 44/1 SR, 51

[56] References Cited

U.S. PATENT DOCUMENTS

| | | | |
|---|---|---|---|
| 3,932,145 | 1/1976 | Foulke | 44/1 R |
| 4,217,110 | 8/1980 | Verschuur et al. | 44/51 |
| 4,249,910 | 2/1981 | Masologites et al. | 44/1 SR |

*Primary Examiner*—Carl F. Dees

*Attorney, Agent, or Firm*—John B. Goodman

[57] ABSTRACT

A process for forming a coal-oil mixture fuel slurry of enhanced stability comprising the steps of: (1) contacting an aqueous slurry of coal particles containing ash and iron pyrite mineral matter with a promoting amount of at least one conditioning agent capable of modifying or altering the existing surface characteristics of the pyrite under conditions to effectuate alteration or modification of at least a portion of ash and the contained pyritic sulfur; (2) agglomerating the coal particles while said pyrite surfaces are altered or modified in an aqueous medium with hydrocarbon oil; (3) separating coal hydrocarbon oil agglomerates from at least a portion of the iron pyrite mineral matter and ash; and (4) mixing the separated coal hydrocarbon oil agglomerates with a quantity of fuel oil to form a coal-oil mixture of enhanced stability.

14 Claims, No Drawings

PROCESS FOR FORMING STABLE COAL-OIL MIXTURES

BACKGROUND OF THE INVENTION

1. Field of the Invention

The field of this invention relates to a method for providing stable coal-oil mixture fuel slurries and novel stable coal-oil mixture fuel slurries.

2. Prior Art

With the rising cost of petroleum, coal has attracted renewed interest as a fuel. One potential way of using coal as a fuel is to form mixtures of coal and oil. Coal-oil mixtures can have the following advantages over coal particles alone.

(1) Coal-oil mixtures are higher in the calorific value than coal.

(2) With some modification, existing petroleum combustion equipment can be used.

(3) Marine transportation by tankers is possible such that large quantities of coal can be transported at high efficiency.

(4) Long-distance land transportation (pipe line transportation) is possible.

(5) Spontaneous combustion of coal during transportation can be prevented and therefore, it becomes possible to export brown coal which has not been exported in spite of its low price because spontaneous combustion readily occurs in brown coal.

(6) Storage space at the site of use can be reduced.

A known problem of coal-oil mixtures is that the mixtures are not stable, i.e., denser coal particles tend to separate or settle from the less dense fuel oil. Heretofore, attempts have been made to stabilize mixtures of coal and oil to prevent the mixture from separating into its components.

For example, British Pat. No. 1,523,193 discloses more stable mixtures of coal and fuel oil are obtained by employing coal particles having a particle size below 10 microns. While employing coal particles haveing a particle size below 10 microns may increase stability, reducing coal particles to this size can be difficult and expensive.

U.S. Pat. No. 4,171,957 to Moriyama discloses adding various sulfonated compounds to mixtures of coal and fuel oil to stabilize the mixture. U.S. Pat. No. 4,201,552 to Rowell et al discloses various quaternary ammonium salts can stabilize coal-oil mixtures. These stabilizing compounds are not wholly satisfactory for stabilizing coal-oil mixtures because they introduce undesirable sulfur and nitrogen compounds to the fuel which can form pollutants on burning.

In short, while much attention has been directed heretofore for forming stable mixtures of coal and fuel oil, there remains an existing need for identifying more suitable ways for forming stable mixtures of coal and fuel oil for use as fuels.

SUMMARY OF THE INVENTION

In summary, this invention relates to a process for providing a coal-oil mixture fuel slurry of enhanced stability comprising steps of:

(1) contacting an aqueous slurry of coal particles containing ash and iron pyrite mineral matter with a promoting amount of at least one conditioning agent capable of modifying or altering the existing surface characteristics of non-pyritic ash and the pyrite under conditions to effectuate alteration or modification of at least a portion of non-pyritic ash and the contained pyritic sulfur;

(2) agglomerating the coal particles while said ash and pyrite surfaces are altered or modified in (3) separating coal hydrocarbon oil agglomerates from at least a portion of the iron pyrite mineral matter and ash; and (4) mixing the separated coal hydrocarbon oil agglomerates with a quantity of fuel oil to form a coal-oil mixture of enhanced stability.

The coal-oil mixture is especially suitable for use as an industrial fuel.

DETAILED DESCRIPTION OF THE INVENTION AND ITS PREFERRED EMBODIMENTS

In its broad aspect this invention provides a process for providing a coal-oil mixture fuel slurry of enhanced stability comprising the steps of:

(1) contacting an aqueous slurry of coal particles containing ash and iron pyrite mineral matter with a promoting amount of at least one conditioning agent capable of modifying or altering the existing surface characteristics of the pyrite under conditions to effectuate alteration or modification of at least a portion of ash and the contained pyritic sulfur;

(2) agglomerating the coal particles while said pyrite surfaces are altered or modified in an aqueous medium with hydrocarbon oil;

(3) separating coal hydrocarbon oil agglomerates from at least a portion of the iron pyrite mineral matter and ash; and (4) mixing the separated coal hydrocarbon oil agglomerates with a quantity of fuel oil to form a coal-oil mixture of enhanced stability.

Suitable coals which can be employed in the process of this invention include bituminous, semi-anthracite, and anthracite.

Coal particles can be provided by grinding coal dry or grinding a water slurry of coal. Conventional methods can be employed to grind the coal. The coal particles employed in the process should be 80 mesh minus, and preferably 100 mesh minus or smaller.

Conditioning agents useful herein include inorganic compounds which can hydrolyze in water, preferably under the conditions of use, and the hydrolyzed forms of such inorganic compounds, preferably such forms which exist in effective amounts under the condition of use. Proper pH and temperature conditions are necessary for some inorganic compounds to exist in hydrolyzed form. When this is the case, such proper conditions are employed. The inorganic compounds which are hydrolyzed or exist in hydrolyzed form under the given conditions of contacting (e.g., temperature and pH) can modify or alter the existing surface characteristics of ash and the pyrite. Preferred inorganic compounds are those which hydrolyze to form high surface area inorganic gels in water, such as from about 5 square meters per gram to about 1000 square meters per gram.

Examples of such conditioning agents are the following:

I. Metal Oxides and Hydroxo-metal complex ion Hydroxides having the formula: $M_aO_b.\times H_2O$ and $M(OH)_c.\times H_2O$, $M_y(OH)_z^{n+}$, wherein M is Al, Fe, Co, Ni, Zn, Ti, Cr, Mn, Mg, Pb, Ca, Ba, Sn, In or Sb; a, b and c are whole numbers dependent upon the ionic valence of M; x is a whole number within the range from 0 to about 3; and n, z and y are a whole number within the range from 1–4.

Preferably M is a metal selected from the group consisting of Al, Fe, Mg, Sn, Zn, Ca and Ba. These metal oxides and hydroxides are known materials. Examples of such materials are aluminum hydroxide gels in water at pH 7 to 7.5. Such compounds can be readily formed by mixing aqueous solutions of water-soluble aluminum compounds, for example, aluminum nitrate or aluminum acetate, with suitable hydroxides, for example, ammonium hydroxide. In addition, a suitable conditioning agent is formed by hydrolyzing bauxite ($Al_2O_3.\times H_2O$) in alkaline medium to an alumina gel. Stanous hydroxide, ferrous hydroxide and zinc hydroxide are preferred conditioning agents. Calcium hydroxide represents another preferred conditioning agent. Calcined calcium and magnesium oxides, and their hydroxides as set forth above, are also preferred conditioning agents. Mixtures of such compounds can very suitably be employed. The compounds are preferably suitably hydrolyzed prior to contacting with coal particles in accordance with the invention.

II. Metal aluminates having the formula:

$M'_d(AlO_3)_e$ or $M'_f(AlO_2)_g$, wherein M' is Fe, Co, Ni, Zn, Mg, Pb, Ca, Ba, or Mo; and d, e, f and g are whole numbers dependent on the ionic valence of M'.

Compounds wherein M' is Fe, Ca or Mg, i.e., iron, calcium and magnesium aluminates are preferred. These preferred compounds can be readily formed by mixing aqueous solutions of water-soluble calcium and magnesium compounds, for example, calcium or magnesium acetate with sodium aluminate. Mixtures of metal aluminates can very suitably be employed. The compounds are most suitably hydrolyzed prior to contacting with coal particles in accordance with the invention.

III. Aluminosilicates having the formula: $AL_2O_3.\times SiO_2$, wherein x is a number within the range from about 0.5 to about 5.0.

A preferred aluminosilicate conditioning agent for use herein has the formula $Al_2O_3.4SiO_2$. Suitable aluminosilicates for use herein can be formed by mixing together in aqueous solution a water-soluble aluminum compound, for example, aluminum acetate, and a suitable alkali metal silicate, for example, sodium metasilicate, preferably, in suitable stoichiometric amounts to provide preferred compounds set forth above.

IV. Metal silicates wherein the metal is calcium, magnesium, barium, iron or tin.

Metal silicates can be complex mixtures of compounds containing one or more of the above mentioned metals. Such mixtures can be quite suitable for use as conditioning agents.

Calcium and magnesium silicates and mixtures thereof are among the preferred conditioning agents of this invention.

These conditioning agents can be prepared by mixing appropriate water-soluble metal materials and alkali metal silicates together in an aqueous medium. For example, calcium and magnesium silicates, which are among the preferred conditioning agents, can be prepared by adding a water soluble calcium and/or magnesium salt to an aqueous solution or dispersion of alkali metal silicate.

Suitable alkali metal silicates which can be used for forming the preferred conditioning agents are potassium silicates and sodium silicates. Alkali metal silicates for forming preferred calcium and magnesium conditioning agents for use herein are compounds having $SiO_2:M_2O$ formula weight ratios up to 4:1, wherein M represents an alkali metal, for example, K or Na.

Alkali metal silicate products having silica-to-alkali weight ratios ($SiO_2:M_2O$) up to about 2 are water-soluble, whereas those in which the ratio is above about 2.5 exhibit less water solubility, but can be dissolved by steam under pressure to provide viscous aqueous solutions or dispersions.

The alkali metal silicates for forming preferred conditioning agents are the readily available potassium and sodium silicates having $SiO_2:M_2O$ formula weight ratios up to 2:1. Examples of specific alkali metal silicates are anhydrous $Na_2SiO_3$ (sodium metasilicate), $Na_2Si_2O_5$ (sodium disilicate), $Na_4SiO_4$ (sodium orthosilicate), $Na_6Si_2O_7$ (sodium pyrosilicate) and hydrates, for example, $Na_2SiO_3.n\ H_2O$ (n=5,6,8 and 9), $Na_2Si_4O_9.\ 7H_2O$ and $Na_3HSiO_4.5H_2O$. Examples of suitable water-soluble calcium and magnesium salts are calcium nitrate, calcium hydroxide and magnesium nitrate. The calcium and magnesium salts when mixed with alkali metal silicates described hereinbefore form very suitable conditioning agents for use herein.

Calcium silicates which hydrolyze to form tobermorite gels are especially preferred conditioning agents for use in the process of the invention.

V. Inorganic Cement Materials

Inorganic cement materials are among the preferred conditioning agents of the invention. As used herein, cement material means an inorganic substance capable of developing adhesive and cohesive properties such that the material can become attached to mineral matter. Cement materials can be discrete chemical compounds, but most often are complex mixtures of compounds. The most preferred cements (and fortunately, the most readily available cements) are those cements capable of being hydrolyzed under ambient conditions, the preferred conditions of contacting with coal in the process of this invention.

These preferred cement materials are inorganic materials which, when mixed with a selected proportion of water, form a paste that can set and harden. Cement and materials used to form cements are discussed in Kirk-Othmer, Encyclopedia of Chemical Technology, 2nd Edition, volume 4, (1964) John Wiley & Sons, Inc., Pages 684 to 710 thereof are incorporated herein by reference. Examples of cement materials include calcium silicates, calcium aluminates, calcined limestone and gypsum. Especially preferred examples of cement materials are the materials employed in hydraulic limes, natural cement, masonry cement, pozzolan cement and portland cement. Such materials will often include magnesium cations in addition to calcium, e.g., dolomite.

Commercial cement materials, which are very suitable for use herein, are generally formed by sintering calcium carbonate (as limestone), or calcium carbonate (as limestone) with aluminum silicates (as clay or shale). Preferably, such materials are hydrolyzed prior to use as conditioning agents.

VI. Ferrous Iron Compounds

Certain ferrous iron compounds are the preferred conditioning agents of the process of this invention.

Conditioning agents found especially useful herein include ferrous iron compounds which exhibit some degree of solubility under the conditions of use. Among such conditioning agents are ferrous iron compounds which can hydrolyze in water, and the hydrolyzed forms of such ferrous iron compounds, preferably such forms which exist in effective amounts under the conditions of use. Proper pH and temperature conditions are necessary for some ferrous compounds to exist in an effective form. Preferred iron compounds include, for example, ferrous sulfate, nitrate, chloride, hydroxide, and acetate. The ferrous iron conditioning agents of this invention are employed at a pH maintained within the range from about 5.5 to about 11.0 and preferably maintained within the range from about 6.0 to about 9.0, and more preferably within the range of from about 6.0 to 8.0. More preferably, the pH is substantially neutral. Substantially neutral conditions may be conveniently maintained by the inclusion of finely divided limestone, or a similar alkaline earth carbonate, in the system to react with any acidic components released from the coal.

With some coals, the mineral matter associated with the coal may be such that on treatment under proper conditions of temperature and pH the mineral matter can be modified in situ to provide the suitable hydrolyzed inorganic conditioning agents for carrying out the process. In such cases, additional conditioning agents may or may not be required depending on whether an effective amount of conditioning agent is generated in situ.

The conditioning agents suitable for use herein can be employed alone or in combination.

The coal particles are contacted with the conditioning agent in an aqueous medium by forming a mixture of the coal particles, conditioning agent and water. The mixture can be formed, for example, by grinding coal in the presence of water and adding a suitable amount of conditioning agent. Another very suitable contacting method involves forming an aqueous mix of conditioning agent, water and coal and then crushing the coal with the aqueous mix of conditioning agent, for example, in a ball mill, to particles of a suitable size. Preferably, the aqueous medium contains from about 5% to about 50%, more preferably from about 5% to about 30%, by weight of the aqueous medium, of coal particles.

The coal particles are contacted for a period of time and under conditions of temperature and pressure sufficient to modify or alter the existing surface characteristics of the pyritic mineral matter sulfur in the coal such that it becomes more amenable to separation from the coal when the coal is agglomerated with hydrocarbon oil. The optimum time will depend upon the particular reaction conditions and the particular coal employed. Generally, a time period in the range of from about 1 minute to 2 hours or more, can be satisfactorily employed. Preferably, a time period of from 10 minutes to 1 hour is employed. During this time, agitation can be desirably employed to enhance contacting. Known mechanical mixers, for example, can be employed.

An amount of conditioning agent is employed which is sufficient to promote the separation of pyrite and ash from coal. Generally, the proportion of conditioning agent, based on coal, will be within the range from about 0.01 to 15 wt. %, desirably within the range from about 0.05 to 10 wt. %, and preferably within the range from about 0.5 to 5 wt. %.

It is usually preferred to base the dosage of conditioning agent upon the mineral matter content of the coal. Depending upon the type and source of the feed coal, the mineral matter content may vary widely and is generally within the range from about 5 to about 60 wt. %, and usually from about 10 to about 40 wt. %, based on the feed coal. Dosage of the conditioning agent may vary within the range from about 0.05 to 30 wt. %, preferably about 0.10 to 15 wt. %, and most preferably from about 1.0 to 10 wt. %, based on mineral matter.

Preferably, the coal is contacted with the conditioning agent in aqueous medium. The contacting is carried out at a temperature such to modify or alter the ash and pyritic surface characteristics. For example, temperatures in the range of about 0° C. to 100° C., can be employed preferably from about 20° C. to about 70° C., and still more preferably from about 20° C. to about 35° C., i.e. ambient conditions. Temperatures above 100° C. can be employed, but are not generally preferred since a pressurized vessel would be required. Temperatures in excess of 100° C. and pressures above atmospheric, generally pressures of from about 5 psig to about 500 psig, can be employed, however, and can even be preferred when a processing advantage is obtained. Elevated temperatures can be useful, for example, if the viscosity and/or pour point of the hydrocarbon oil employed is too high at ambient temperatures to selectively agglomerate the coal.

The process step whereby the sulfur-containing coal particles are contacted with conditioning agent in aqueous medium may be carried out in any conventional manner, e.g. batchwise, semi-batchwise or continuously. Since ambient temperatures can be used, conventional equipment will be suitable.

An amount of hydrocarbon oil necessary to form coal hydrocarbon oil agglomerates can be present during this conditioning step. Alternatively, and preferably, after the coal particles have been contacted with the conditioning agent in aqueous solution for a sufficient time, the coal particles are agglomerated with hydrocarbon oil.

Coal-oil agglomerates are readily formed by agitating a mixture of water, hydrocarbon oil and coal particles. In the process of this invention, it is preferred to add the hydrocarbon oil to the aqueous medium of coal particles and conditioning agent, and agitate the resulting mixture to agglomerate the coal particles. If necessary, the water content of the mixture can be adjusted to provide for optimum agglomerating. Generally from about 30 to 95 parts water, and more preferably 40 to 90 parts water, based on the weight of coal, is most suitable for agglomeration. There should be sufficient hydrocarbon oil present to agglomerate the coal particles. The optimum amount of hydrocarbon oil will depend upon the particlar hydrocarbon oil employed, the size and rank of the coal particles. Generally, the amount of hydrocarbon oil will be from about 1% to 30%, preferably 2% to 30%, by weight, of coal. Most preferably the amount of hydrocarbon oil will be from about 2% to 15%, by weight, of coal. As stated above, it is an important part of this invention that the agglomeration and separation of the coal particles be effectuated before realteration or remodification of the iron pyrite mineral matter.

Suitable hydrocarbon oils for forming the coal-oil agglomerates are derived from petroleum, shale oil, tar sand and coal. Especially suitable hydrocarbon oils are light and heavy refined petroleum fractions such as light cycle oil, heavy cycle oil, heavy gas oil, clarified oil, kerosene, heavy vacuum gas oil, residual oils, coal tar and other coal derived oils. Mixtures of various hydrocarbon oils can be quite suitable; particularly when one of the materials is very viscous.

As used herein "coal agglomerate" means an aggregate of a plurality of coal particles. These coal agglomerates can have a wide range of particle sizes. For example, agglomerates include small aggregates or flocs formed of several coal particles such that the aggregate is about 2 times, preferably from about 3 to 10 times, the average size of the coal particles which make up the agglomerate. (Such small agglomerates can be referred to as flocs or aggregates and are included within the term agglomerate). Agglomerates can also include a large plurality of particles such that the agglomerate size is quite large. For example, agglomerates in the shape of balls having diameters of from about ⅛ inch to 1 inch, or larger can be formed.

Agitating the mixture of water, hydrocarbon oil and coal particles to form coal-oil agglomerates can be suitably accomplished using stirred tanks, ball mills or other apparatus.

The resulting coal-oil agglomerates can be separated from ash and pyrite using a variety of separation techniques.

The conditioning agents alter or modify the ash and pyrite by associating with the pyrite or alter the existing pyrite surface physically or chemically to impart to the modified or altered pyrite surface more mineral-like surface characteristics. Since these altered or modified pyrite mineral surface characteristics differ from the surface characteristics of the coal particles such that the coal particles preferentially agglomerate with the hydrocarbon oil. Advantage is taken of this fact at the time of separation also separate the conditioned ash and pyrite from the coal oil agglomerates.

Preferably a separation is effected by taking advantage of the size difference between coal-oil agglomerates and unagglomerated mineral matter. For example, the coal-oil agglomerates can be separated from the water and liberated ash and pyrite, e.g., by filtering with bar sieves or screens, which predominately retain the coal-oil agglomerates, but pass water and unagglomerated mineral matter. When this technique is employed, coal-oil agglomerates of a size suitable for ready filtering must be formed.

Often it is desired to use small amounts of oil to form coal-oil agglomerates. Small amounts of oil, however, may provide small coal-oil agglomerates. Small coal-oil agglomerates (aggregates and flocs) can be more desirably separated by taking advantage of the different surface characteristics of the coal-oil agglomerates, and ash and conditioned pyrite, for example, employing well known froth flotation and/or skimming techniques.

The separated coal hydrocarbon oil agglomerates are mixed with a quantity of fuel oil to form a coal oil mixture fuel slurry of enhanced stability.

The term "fuel oil" as used herein means petroleum crude oil and liquid fractions thereof such as kerosene, light oil, heavy oils such as bunker A, bunker B and bunker C. Among the fuel oils, bunker A, bunker B and bunker C are most preferable because they are readily available in large quantities at a relatively low cost. Mixtures of fuel oils can be used. In cases where two or more different types of oils are to be mixed, they may be mixed either prior to or subsequent to the mixing step with coal-oil agglomerates.

The content of coal in the final fuel slurry preferably ranges from 20 to 60% by weight, more preferably from 30 to 50% by weight of the fuel slurry of the fuel slurry. Higher coal contents result in an increase in viscosity with a decrease in fluidity and lower coal contents are economically insignificant.

The coal-oil mixture fuel slurries formed by the process of this invention can contain from about 0 to 15 percent, by weight of the fuel slurry, water. It has been found that small amounts of water can enhance the stability of the coal-oil mixture fuel slurry. Small amounts of water are, therefore, a preferred component of the coal-oil mixture fuel slurry. Preferred coal-oil mixture fuel slurries of the invention contain, for example, from about 1 to 10 percent, more preferably, from about 2 to 8 percent, by weight of the fuel slurry of water.

The following Example illustrates a specific preferred embodiment of the invention.

EXAMPLE

Ohio #6 run-of-mine coal was ground in water in a porcelain ball mill with porcelain balls to attain a particle size of 100 mesh minus. An aliquot portion of the ground run-of-mine coal was removed and dewatered. Another portion of the run-of-mine coal was removed and additional water was added to form an aqueous slurry containing about 30% by weight coal. Ferrous sulfate (0.4% by weight of coal), a conditioning agent, and finely ground limestone were (in an amount sufficient to maintain a pH of about 8) added to the aqueous coal slurry. The resulting mixture was agitated for 30 minutes. About 25% of light cycle oil, by weight of coal, was slowly added to the mixture with mild agitation forming coal-oil agglomerates. These cleaned coal-oil agglomerates were separated from the mixture by pouring the mixture over a screen. Rejected ash and pyrite passed through the screen with the water. The cleaned coal-oil agglomerates were washed several times with water and then dewatered. Coal-oil mixtures (COM) were formed employing the ground run of-mine coal and the coal-oil agglomerates. In each case coal and water were added to fuel oil #6 (API=11) and vigorously agitated for about 1 hour to form a homogeneous coal-oil mixture.

The coal-oil mixtures were transferred to graduated cylinders and their respective stabilities were evaluated. The results are set forth below:

STABILITY TEST OF COM
30 wt. % Ohio #6
Temperature 50° C.

| Coal | % $H_2O$ in COM | 6 days | 10 days | 20 days | 30 days |
|---|---|---|---|---|---|
| Run-of-mine | 6 | Half Settled | Settled | — | — |
| Cleaned | 6 | — | Stable | Stable | Stable |

What is claimed is:

1. A process for providing a coal-oil mixture fuel slurry of enhanced stability comprising the steps of:

(1) contacting an aqueous slurry of coal particles containing ash and iron pyrite mineral matter with a promoting amount of at least one conditioning agent capable of modifying or altering the existing surface characteristics of the pyrite under conditions to effectuate alteration or modification of at least a portion of the contained pyritic sulfur;

(2) agglomerating the coal particles while said pyrite surfaces are altered or modified in an aqueous medium with hydrocarbon oil;

(3) separating coal hydrocarbon oil agglomerates from at least a portion of the iron pyrite mineral matter and ash; and (4) mixing the separated coal hydrocarbon oil agglomerates with a quantity of fuel oil to form a coal-oil mixture fuel slurry of enhanced stability.

2. The process of claim 1 wherein the conditioning agent is selected from the group consisting of metal oxides and hydroxides having the formula $M_aO_b.\times H_2O$ or $M(OH)_c.\times H_2O$ wherein M is Al, Fe, Co, Ni, Zn, Ti, Cr, Mn, Mg, Pb, Ca, Ba, In or Sb; a, b and c are whole numbers dependent upon the ionic valence of M; and x is a whole number within the range from 0 to 3.

3. The process of claim 2 wherein the conditioning agent is selected from the group consisting of calcium oxide, magnesium oxide and mixtures thereof.

4. The process of claim 1 wherein the conditioning agent is selected from the group consisting of aluminum oxide, aluminum hydroxide and mixtures thereof, hydrolyzed in water to form an alumina gel.

5. The process of claim 1 wherein the conditioning agent is selected from the group consisting of metal aluminates having the formula $M'_d(AlO_3)_e$ or $M'_f(AlO_2)_g$, wherein M' is Fe, Co, Ni, Zn, Mg, Pb, Ca, Ba or Mc; and de, e, f and g are whole numbers dependent upon the ionic valence of M'.

6. The process of claim 5 wherein the conditioning agent is selected from the group consisting of calcium, magnesium, and iron aluminates and mixtures thereof.

7. The process of claim 1 wherein the conditioning agent is selected from the group consisting of aluminosilicates having the formula $Al_2O_3.\times SiO_2$, wherein x is a number within the range from about 0.5 to about 5.0.

8. The process of claim 1 wherein the conditioning agent is selected from the group consisting of metal silicates wherein the metal is calcium, magnesium, barium, iron or tin.

9. The process of claim 8 wherein the conditioning agent is selected from the group consisting of calcium silicate, magnesium silicate and mixtures thereof.

10. The process of claim 1 wherein the conditioning agent is selected from the group consiting of inorganic cement materials capable of binding mineral matter.

11. The process of claim 10 wherein the conditioning agent is selected from the group consisting of portland cement, natureal cement, masonry cement, pozzolan cement, calcined limestone and calcined dolomite.

12. The process of claim 11 wherein the cement material is hydrolyzed portland cement.

13. The process of claim 1 wherein the conditioning agent is a material which has a ferrous component and is maintained at a pH value of from about 5.5 to 11.0.

14. The process of claim 13 wherein the conditioning agent comprises an aqueous solution of a ferrous salt maintained at a pH value of from about 6 to about 9.

* * * * *